US011667511B2

(12) United States Patent
Tanchette

(10) Patent No.: US 11,667,511 B2
(45) Date of Patent: Jun. 6, 2023

(54) SYSTEM FOR DISPENSING LIQUID

(71) Applicant: SOCIÉTÉ ANONYME DES EAUX MINÉRALES D'EVIAN ET EN ABRÉGÉ "S.A.E.M.E", Évian-les-Bains (FR)

(72) Inventor: Jean-Baptiste Tanchette, Messery (FR)

(73) Assignee: SOCIÉTÉ ANONYME DES EAUX MINÉRALES D'EVIAN ET EN ABRÉGÉ "S.A.E.M.E", Évian-les-Bains (FR)

( * ) Notice: Subject to any disclaimer, the term of this patent is extended or adjusted under 35 U.S.C. 154(b) by 0 days.

(21) Appl. No.: 17/268,880

(22) PCT Filed: Apr. 10, 2020

(86) PCT No.: PCT/EP2020/060344
§ 371 (c)(1),
(2) Date: Feb. 16, 2021

(87) PCT Pub. No.: WO2020/208241
PCT Pub. Date: Oct. 15, 2020

(65) Prior Publication Data

US 2022/0017353 A1 Jan. 20, 2022

(30) Foreign Application Priority Data

Apr. 12, 2019 (EP) ..... 19305475

(51) Int. Cl.
*B67D 3/00* (2006.01)
*B67D 3/02* (2006.01)
*B67D 3/04* (2006.01)

(52) U.S. Cl.
CPC ..... *B67D 3/0032* (2013.01); *B67D 3/0067* (2013.01); *B67D 3/0083* (2013.01); *B67D 3/02* (2013.01); *B67D 3/04* (2013.01)

(58) Field of Classification Search
CPC .. B67D 3/0032; B67D 3/0067; B67D 3/0083; B67D 3/02; B67D 3/04
See application file for complete search history.

(56) References Cited

U.S. PATENT DOCUMENTS 3,447,720 A 6/1969 Janigian et al.
4,293,082 A * 10/1981 Matsueda ..... B67D 3/0019 222/131

(Continued)

FOREIGN PATENT DOCUMENTS

EP 1645523 A2 4/2006
EP 2816004 A1 12/2014

(Continued)

OTHER PUBLICATIONS

Foreign Communication from a Related Counterpart Application, International Search Report and Written Opinion dated May 28, 2020, International Application No. PCT/EP2020/060344 filed on Apr. 10, 2020.

(Continued)

*Primary Examiner* — Frederick C Nicolas

(57) ABSTRACT

A system for dispensing a liquid to a user, that includes a container having a reference container volume and a wall with: a bottom portion, a side portion adjacent to the bottom portion, a shoulder portion adjacent to the side portion, a liquid, in the container, a dispenser, arranged to receive and hold the container, characterized in that: the bottom portion and the shoulder portion have a similar male shape. The dispenser includes a receiving portion having a female shape arranged to mate either with the bottom portion or with the shoulder portion, so as to stably hold the container.

20 Claims, 8 Drawing Sheets

(56) References Cited

U.S. PATENT DOCUMENTS

| | | | | |
|---|---|---|---|---|
| 5,217,128 | A * | 6/1993 | Stenger | B65D 1/0223 215/370 |
| 5,431,205 | A | 7/1995 | Gebhard | |
| 5,647,416 | A | 7/1997 | Desrosiers et al. | |
| 5,791,517 | A * | 8/1998 | Avital | B67D 3/043 222/481.5 |
| 7,051,892 | B1 * | 5/2006 | O'Day, Jr. | B65D 1/0276 220/675 |
| 7,472,807 | B1 * | 1/2009 | Black | B67D 3/02 222/481.5 |
| 7,896,180 | B2 * | 3/2011 | Kenney | B65D 81/3222 215/11.4 |
| 8,783,304 | B2 * | 7/2014 | Markoski | H01M 8/04201 141/330 |
| 8,875,944 | B2 * | 11/2014 | Shiotani | B67D 3/0032 222/64 |
| 9,346,660 | B2 * | 5/2016 | Orita | B67D 3/0032 |
| 9,840,405 | B2 * | 12/2017 | Giuffrida | B67D 1/0891 |
| 2009/0057340 | A1 * | 3/2009 | Moothart | B67D 3/0029 222/113 |
| 2012/0097291 | A1 * | 4/2012 | Almada | B67D 3/0061 141/2 |
| 2015/0029895 | A1 | 1/2015 | Smelyansky et al. | |
| 2015/0097000 | A1 * | 4/2015 | Luebbers | A45C 11/20 222/105 |
| 2015/0298957 | A1 | 10/2015 | Orita | |
| 2022/0017346 | A1 * | 1/2022 | Tanchette | B67D 1/0891 |

FOREIGN PATENT DOCUMENTS

| | | | |
|---|---|---|---|
| WO | 201007744 | A1 | 1/2010 |
| WO | 20200208241 | A1 | 4/2020 |

OTHER PUBLICATIONS

Foreign Communication from a Related Counterpart Application, Extended European Search Report dated Oct. 22, 2019, European Application No. 19305475.6 filed on Apr. 12, 2019.

* cited by examiner

SYSTEM FOR DISPENSING LIQUID

CROSS-REFERENCE TO RELATED APPLICATIONS

The present application is a filing under 35 U.S.C. 371 as the National Stage of International Application No. PCT/EP2020/060344, filed Apr. 10, 2020, entitled "SYSTEM FOR DISPENSING LIQUID," which claims priority to European Application No. 19305475.6 filed with the European Patent Office on Apr. 12, 2019, both of which are incorporated herein by reference in their entirety for all purposes.

The present invention relates to a system for dispensing liquid, comprising a dispenser arranged for receiving a container full a liquid.

BACKGROUND

Document WO201007744 describes a water dispensing system comprising a container and a dispenser. In such known system, the user has to handle a deformable container full of liquid, to install the container in an upside down position so a to insert the neck portion of the container in a receiving portion of the dispenser. However, such handling, especially if the container is of a large volume (typically about 5 liters), is difficult. If the user has in addition to withdraw a seal or a cap before installation, handling is even more difficult, and there is a risk of liquid spillage upon withdrawing the seal or cap due to the deformability of the container.

Documents U.S. Pat. No. 5,431,205 A, US2015/0298957 A1, EP 1645523 A2, U.S. Pat. No. 5,647,416 A disclose systems comprising a bottle or a container and a dispenser. However, none of the systems disclosed by these documents propose any solution for providing an improved ease of use when handling the bottle or container.

SUMMARY

The present invention aims to address the above mentioned drawbacks of the prior art, and to propose a system for dispensing a liquid to a user, with improved handling of the container, especially when it is full of liquid.

In this aim, a first aspect of the invention is a system for dispensing a liquid to a user, comprising:

a container having a reference container volume and comprising a wall with:

a bottom portion, a side portion adjacent to the bottom portion, a shoulder portion adjacent to the side portion, a liquid, in the container, a dispenser, arranged to receive and hold the container, characterized in that:

the bottom portion and the shoulder portion have a similar male shape, the dispenser comprises a receiving portion having a female shape arranged to mate either with the bottom portion or with the shoulder portion, so as to stably hold the container. The container comprises a shoulder portion having a shape similar to the shape of the bottom portion, so that the receiving portion of the dispenser is designed to receive the container in an upright position, in the same manner than in the dispensing (upside down) position. In other words, the coupling or mating (interpenetration) provided by the receiving portion is the same with bottom or shoulder portion. Consequently, the user can place the container full of liquid in the upright position in the receiving portion of the dispenser, in a stable manner. Then the user can optionally remove a seal, a cap, a protective cover from the container, and he can adequately re-grasp, re-grab or re-seize the container for returning it to place it again in the receiving portion, in the dispensing position. The ease of use is improved, as the user can equally deposit the container in both positions (upright or upside down). The user can for example hold the neck of the container upon removing the seal and hold the container without deformation, and optionally place a valve while holding the neck and holding the container without deformation.

Advantageously, the coupling or mating (interpenetration) provided by the receiving portion is limited to the bottom or shoulder portion. There is no interaction between the side portion and the receiving portion. Accordingly, the height of the receiving portion can be limited to that of the bottom or receiving portion.

Advantageously, in a longitudinal cross section plane, the bottom portion presents a bottom curvature BC, the shoulder portion presents a shoulder curvature SC, and:

$$BC=SC\pm20\%.$$

Advantageously, the bottom portion and the shoulder portion, in a longitudinal cross section plane, present a curvature free of inflexion point. In other words, from the side portion to the neck portion, the intersecting curve (of bottom portion and the shoulder portion with the cross section plane) does not change from concave to convex or vice versa.

Advantageously, the side portion presents an external diameter ED, and the bottom portion presents in a longitudinal cross section plane a bottom curvature BC (radius), and:

$$BC=ED/2\pm30\%.$$

According to the above embodiment, the radius of bottom curvature BC might be constant or not, but in any point, it satisfies the above mentioned relationship, so that it presents a significant curvature, rendering the container unable to rest in a stable position onto a flat surface.

Advantageously, the bottom portion and the shoulder portion present an hemispherical shape. This kind of shape is easy to manufacture, especially with a blow moulding process and the pressure of the container is correctly distributed to the receiving portion.

Advantageously, the receiving portion is removable from the dispenser. This allows to replace the receiving portion to provide capacity to receive different kinds/shapes of containers.

Advantageously, the system comprises several different receiving portions, so as to allow installation of different kinds/shapes of containers.

Advantageously, the system comprises shape recognition means, arranged to recognize the kind/shape of the receiving portion installed into the dispenser. It is possible with this embodiment to adapt the operating of the system, to the kind/shape of the receiving portion/container.

Advantageously, the receiving portion comprises at least one anti slippage portion, for example at least one insert made of high friction material, such as rubber (natural rubber, synthetic rubber such as ethylene propylene diene methylene rubber . . . ), or for example a portion with high rugosity or roughness, so that the container is prevented from sliding/slipping even if the user unscrews/screws a cap or a valve to the container.

Advantageously, the receiving portion comprises a hollow portion forming a well to receive the neck, when the container is held in the dispensing position. The hollow portion provided in the receiving portion receives the neck portion when the container is in the dispensing position, so that any interference is avoided. Typically, the hollow portion is located in the central lower part of the receiving portion, so that the holding of the container in the upright position is not affected.

Advantageously, the side portion comprises a straight part.

Advantageously, the side portion is cylindrical, preferably a circular cylinder.

Advantageously, the container wall is free of ridge, rib, or groove. According to this embodiment, the container has a smooth wall, so that its deformation or collapse even during dispensing the liquid is facilitated.

Advantageously, the container is made of polyethylene terephthalate (PET), preferably at least partly recycled.

Advantageously, the container has a ratio between its weight and its reference volume of from 5.27 g/L to 9.33 g/L, preferably of from 5.27 g/L to 7.33 g/L, preferably from 5.80 g/L to 7.00 g/L. Such light container has an increased capacity of deformation, even during dispensing liquid when placed in the receiving portion in the dispensing position. Consequently, handling the container full of water is improved as the receiving portion can hold the container in the upright position, as the counter shape of the receiving portion fits closely to the container, the latter is not deformed. Then, the user can even remove a sealing cap (which opens the container), to install a valve. The stable holding (in the upright position when container is open) avoids risks of: leaks, projection of water out of the container, flow out of the container.

Advantageously, the container reference volume is of at least 3.0 L, preferably at least 4.0 L, preferably at least 5.0 L, and preferably of at most 22.0 L, preferably at most 11.0 L. Such large volume makes the container heavy when full of water, and holding provided by the receiving portion gives assistance to re-grasp, re-grab, re-seize the container or re-position hands around the container.

Advantageously, the container is a blow molded container, preferably an injection blow molded container.

Advantageously, the container, when filled with the liquid reference volume and sealed presents at top load resistance of at least 10 daN for at least 5 mm deformation and/or a lateral load resistance of at least 5 daN for at least 2.5 mm deformation.

Advantageously, the system comprises:

a control unit arranged in the dispenser, to be actuated by the user, a valve connected to the container, and connected to the control unit to selectively release or stop a flow of the liquid out of the container, characterized in that:

upon releasing at least a part of the liquid, the container is deformable, the valve releasing a flow of the liquid out of the container when the control unit is actuated by the user, and upon releasing at least another part of the liquid, the valve releases a flow of liquid out of the container, and allows a flow of gas into the container when the control unit is actuated by the user.

According to the above embodiment, the valve is arranged to provide two distinct operating modes. In a first operating mode, there is mainly releasing/draining liquid out of the container. In this first operating mode, the container deforms to compensate the loss of volume caused by the release of liquid (the container deforms so that the container volume decreases to compensate at least 80%, or 90% or 99% or more preferably 100% of the liquid volume drained out of the container). In other words, the container is auto deformable during draining of the liquid. In a second operating mode, there is releasing/draining liquid out of the container, and entry/admission of air into of the container to compensate most of the liquid volume drained out of the container). In this second operating mode, the container might deform to compensate a loss of volume caused by the release of liquid, but the container volume decreases less than 50% or 30% or even 20% of the liquid volume drained out of the container, thereby causing a (significant) entry/admission of air into the container. As a consequence of the container deformation, when fully drained from liquid, the container is in a collapsed state, reducing the space/volume to discard it and to ideally to recycle it. The handling of an empty container according to the present invention is easier. In addition, it is to be noted that the deformation of the container limits the entry of gas/air, so that contamination of remaining liquid in the container is limited. Freshness is thereby improved.

It has to be noted that the first operating mode or second operating mode continuously operate during at least draining liquid for filling a cup or glass, that is to say for draining out of the container a volume of liquid of at least 0.125 liter, preferably at least 0.25 liter, and more preferably at least 0.5 liter.

In other words, the system is arranged so that:

during the first operating mode, to drain out of the container a volume of liquid of at least 0.125 liter, preferably at least 0.25 liter, and more preferably at least 0.5 liter, the valve releases a flow of the liquid out of the container when the control unit is actuated by the user, and the container is deformable so that the container volume decreases by at least 80%, or 90% or 99% or more preferably 100% of the liquid volume drained out of the container, during a second operating mode, to drain out of the container a volume of liquid of at least 0.125 liter, preferably at least 0.25 liter, and more preferably at least 0.5 liter, the valve releases a flow of the liquid out of the container when the control unit is actuated by the user, and the container is deformable by at most 50% or 30% or even 20% of the liquid volume drained out of the container, thereby causing an entry/admission of air into the container.

Typically, transition between first operating mode to second operating mode occurs when at an air entry threshold comprised between 5% and 66%, preferably from 10% to 50%, preferably from 20% to 20% to 40% of the liquid reference volume.

It has to be noted that the system is free of active pumping means. In other words, only gravity causes the release of liquid out of the container, and the system does not comprise any pump.

Advantageously:

during a first dispensing phase, the container is deformable so that the valve only releases a flow of liquid out of the container when the control unit is actuated by the user;

during a second dispensing phase, the valve releases a flow of liquid out of the container, and allows a flow of gas into the container when the control unit is actuated by the user.

Advantageously:

during a first dispensing phase, the container wall is deformable under atmospheric pressure so that an internal container liquid pressure equilibrates with the atmospheric pressure;

during a second dispensing phase, the container wall is less or not deformable under atmospheric pressure so that an internal container liquid pressure is smaller than the atmospheric pressure.

Advantageously, the valve is arranged to be realisably coupled to the container. In other words, the container, when delivered to the user is sealed with a regular cap or lid. The user has to first break this seal (remove cap or lid) to then connect the valve to the container, and then install this assembly into the dispenser.

Advantageously, the valve is arranged to be realisably connected to the control unit.

Advantageously, the liquid is a beverage, preferably water, preferably still water.

Advantageously, the receiving portion is arranged to mate with the shoulder portion so as to hold the container in a stable dispensing position.

Advantageously, the receiving portion is arranged to mate with the bottom portion so as to hold the container in a stable upright position.

Advantageously, the receiving portion has a shape which is a counter shape to the shape of the shoulder portion and/or the bottom portion.

Advantageously, the system further comprises an electronic control unit, arranged to display or send at least one information or instruction message to the user or to a treatment entity. Preferably, the electronic control unit is provided in the dispenser, but might also be (partially) provided with an electronic portable apparatus, such as a smartphone.

Advantageously, the system further comprises a liquid content measurement unit.

Advantageously, the liquid content measurement unit is a weighting unit arranged to weight the liquid in the container and connected to the electronic unit, and the electronic unit is arranged to display or send an information or instruction message based on a container weight measured by the weighting unit.

Advantageously, the message is a reminder to order at least one filled container, or an order for at least one filled container, generated when the liquid content measured by the liquid content measurement unit is below a liquid threshold.

Advantageously, the system comprises:

a clock connected to the electronic unit, a container presence sensor, and wherein the message is a reminder to change the container, or an order for a new filled container, when a period of time, started when the container presence sensor has changed of state to detect installation of a container, is exceeding a freshness time threshold. According to the above mentioned embodiment, the user is informed about the freshness of the liquid stored in the container, and invited to replace the container if it has been installed for a long time, and even if it is not empty.

Advantageously, the message is a reminder to change the container, when a second period of time, started when the container weight has been measured below the weight threshold, is exceeding a gas in container time threshold. According to the above mentioned embodiment, the user is informed about the freshness of the liquid stored in the container, determined on the basis of the presence of air into the container. Indeed, in the first operating mode, there is no or low gas entry into the container, so that the risk of contamination is low. However, in the second operating mode, more gas or air is allowed to enter into the container, so that the might be a risk of contamination or pollution. Therefore, the replacement of the container is sent earlier when the second operating mode has occurred.

Advantageously, the at least one message comprises follow up of liquid consumption. The user is informed about the consumption, to check that he consumed enough per day for instance.

Advantageously, the system comprises at least one container kind recognition sensor, and wherein the electronic control unit is arranged to inhibit the sending of any message, if the container kind recognition sensor fails to recognize an authorized kind of container. Safety of use is increased, and messages might even be adapted to the kind of container detected.

Advantageously, said at least one container kind recognition sensor:

comprises a RFID receiver and a RFID tag, and/or comprises a code reader, and/or comprises a mechanical sensing touch, arranged to be actuated by a specific portion of the container.

A second aspect of the invention is a container for the system according to the first aspect.

A third aspect of the invention is a dispenser for the system according to the first aspect.

A fourth aspect of the invention is a process of dispensing liquid to a user with the system of the first aspect of the invention, comprising the following steps:

positioning the bottom portion of the container full of liquid in the receiving portion so as to hold the container in a stable upright position, removing a seal attached to the container, attaching a normally closed valve to the container, returning the container to position the shoulder portion of the container in the receiving portion so as to hold the container in a stable upside down position, while coupling the valve to a control unit of the dispenser, operating the control unit so as to open the valve and to dispense liquid to the user. The user can easily handle the container, even if the latter is deformable or highly deformable, without risks of water leaks, as the receiving portion provide stable positioning, in the upright and upside down positions.

A fifth aspect of the invention is a use of the system of the first aspect of the invention, comprising the following steps:

positioning the bottom portion of the container in the receiving portion so as to hold the container in a stable upright position, removing a seal attached to the container, attaching a normally closed valve the container, returning the container to position the shoulder of container in the receiving portion so as to hold the container in a stable upside down position, while positioning the valve into a hollow portion of the receiving portion.

BRIEF DESCRIPTION OF THE DRAWINGS

Other features and advantages of the present invention will appear more clearly from the following detailed description of particular non-limitative examples of the invention, illustrated by the appended drawings where.

DETAILED DESCRIPTION

Figure 1:
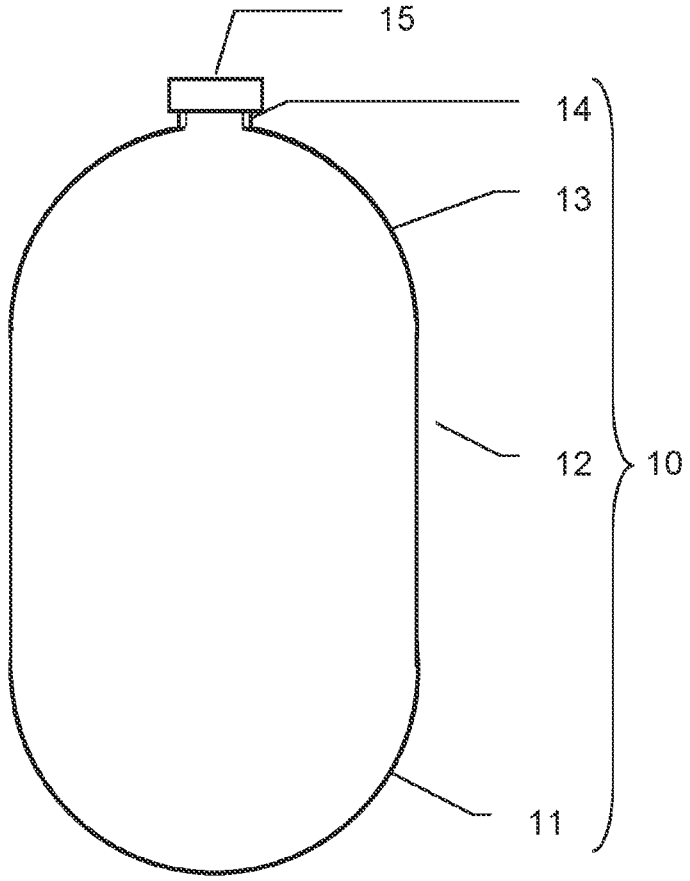
FIG. 1 represents a container for a system according to the present invention.

FIG. 1 represents a container 10 according to the present invention. Container 10 is designed to contain a fluid, and preferably a liquid, more preferably water, still water.

Liquid

The liquid, comprised in the container, and to be released out of the container is preferably a drinkable, potable, liquid. Examples of such liquids include waters and beverages.

Examples of waters include tap water, purified and/or sterilized waters, such as distillated waters, well waters, spring waters, and mineral waters. The waters can be supplemented with some additives such as salts, minerals, electrolytes. The waters can be supplemented with some functional additives such as vitamins. The waters can be acidic, neutral or alkaline waters. The waters can be still waters or sparkling waters, for example carbonated, for example naturally carbonated, artificially carbonated or partially naturally carbonated.

Examples of beverages include alcoholic or non-alcoholic beverages, flavoured waters, aquadrinks, optionally flavoured milks, for example milks form animal origin such as cow milk or vegetal substitutes such as soy milk, almond milk, cashew milk, oat milk, rice milk, coconut milk, fermented beverages such as drinking yogurts or vegetal substitutes, kefirs, kombuchas, infused beverages, ready to use coffees, ready to use teas, ready to use creamers, fruit juices or nectars, carbonated soft drinks such as colas or sodas. The non-alcoholic beverages can for example comprise sugar, sweeteners and/or fruit or vegetable or their extracts.

Container Features

The container 10 is typically made of a plastic material. The plastic material and the container structural features, such as the thickness and the shape, are such that the container has preferably at least a deformable, flexible, part when it is empty. Examples of materials include recyclable polyesters, such as PolyEthylene Terephtalate (PET), PolyTrimethylene Terephtalate (PTT), PolyEthylene 2,5-Furandicarboxylate (PEF), PolyTrimethylene 2,5-Furandicarboxylate (PTF). PET and rPET are for example available in various grades or compositions, for example packaging grades or compositions, for example bottles grades or compositions. PET is especially appropriate for waters. Waters are very sensitive to taste modification, and PET has been found not to alter the waters' taste over storage periods of at least 3 months, preferably at least 6 months, preferably at least 12 months.

The plastic material is preferably recyclable, for example by a mechanical route, a chemical route and/or a microbiological route. PET is recyclable by such routes. The plastic material is preferably at least partly recycled. The plastic material can for example be a 100% recycled material, or comprise an amount of R % by weight of recycled material and an amount of 100-R % of a virgin material, preferably of the same material as the recycled material, wherein R can be of at least 10% or at least 20% or at least 30% or at least 40% or at least 50% or at least 60% or at least 70%, or at least 80%, or at least 90%. The PET can for example be a 100% recycled PET (rPET), or comprise an amount of R % by weight of rPET and an amount of 100-R % of a virgin PET, wherein R can be of at least 10% or at least 20% or at least 30% or at least 40% or at least 50% or at least 60% or at least 70%, or at least 80%, or at least 90%.

The recycling is preferably a post-consumer (PC) recycling, where the container is recycled from waste streams after use by a consumer and disposal by a user or consumer. The rPET can be a PC rPET. The recycling typically involves sorting waste streams, to recover a stream of the selected material, and processing the stream with steps such as refining, washing and/or grinding. For example, PET can be sorted from waste streams, and then processed according to various routes. The mechanical route involves refining, washing and/or grinding to recover a rPET polymer. The recovered rPET polymer can be subjected to a solid state polymerization to re-increase its molecular weight, for example to re-increase its Intrinsic Viscosity (IV). The chemical route involves depolymerizing to recover monomers. The monomers can be repolymerized to obtain a recycled fresh polymer. For example, PET or rPET can be depolymerized by hydrolysis, methanolysis, glycloysis, ammonolysis or aminolysis to obtain recycled terephthalic acid or a diester thereof and recycled monoethylene glycol. The recycled terephthalic acid or diester and/or the recycled monoethylene glycol can be repolymerized, optionally with adding some virgin terephthalic acid or diester and/or the monoethylene glycol. Similarly, the microbiological route involves treating the stream of material by micro-organisms to obtain de-polymerized oligomers or monomers, and then repolymerizing said monomers or oligomers, optionally with adding some virgin monomers or oligomers.

The container can be formed from the plastic material by a molding process, such as a blow molding process, for example an Extrusion Blow Molding process or an Injection Blow Molding process, for example an Injection Stretch Blow Molding process. Injection (Stretch) Blow Molding processes are especially suitable for PET materials. They involve forming a PET preform by injection, heating the preform, placing the preform in a mold, and blowing a gaz, usually air, in the heated preform to blow the material in the mold and conform the material with the mold. Upon blowing the PET stretches, becomes thinner, and gets resistance by strain hardening and/or strain induced crystallization phenomenon(s). Such processes are well known. Equipments and materials, virgin or recycled, are commercially available.

The preform can be a monolayer preform, to obtain a monolayer container. For example, the preform is a monolayer PET. For example, the container can be a monolayer PET container. The preform can be multilayer preform, to obtain multilayer container. For example, the preform can have a layer of virgin PET and a layer of rPET, preferably as an external at least partial layer. For example, the container can have a layer of virgin PET and a layer of rPET, preferably as an external at least partial layer.

The container has a reference volume, defined as the maximum volume when the container is not deformed. This is the state shown on FIG. 1.

The container reference volume can be of at least 3.0 L, preferably at least 4.0 L, preferably at least 5.0 L. The container can have a reference volume of at most 22.0 L, preferably at most 11.0 L. The container can have a reference volume of from 3.0 to 4.4 L or from 4.0 to 5.5 L, or from 5.0 to 6.6 L, or from 6.0 to 7.7 L, or from 7.0 to 8.8 L, or from 8.0 to 9.9 L, or from 9.0 L to 10.0 L. For example, the container shown of the figures has reference volume of from 4.9 L to 5.2 L.

The container is typically filled with a reference volume of the liquid, and sealed. The liquid reference volume is the maximum amount of liquid comprised in the container, before release. The liquid reference volume is typically slightly lower than the container reference volume, as the filled and closed container typically presents a head space (part or the container that is not filled). The head space is preferably of from 0% to 10% of the liquid reference volume, for example from 1% to 10% or from 1% to 5%. The liquid reference volume can be of from of at least 3.0 L, preferably at least 4.0 L, preferably at least 5.0 L. The liquid reference volume can be of at most 20.0 L, preferably at most 10.0 L. The liquid reference volume can be of from 3.0 to 4.0 L or from 4.0 to 5.0 L, or from 5.0 to 6.0 L, or from 6.0 to 7.0 L, or from 7.0 to 8.0 L, or from 8.0 to 9.0 L, or from 9.0 L to 10.0 L, or from 10.0 to 15.0 L, or from 15.0 to 20.0 L. For example, the liquid reference volume can be of from 4.9 L to 5.1 L.

The filled container, before use, is typically sealed by a closure. The closure can be any type of closure, for example a cap or a flexible lid. The closure can be for example a threaded cap or a snap cap. The container can be opened by removing the closure or by at least partially piercing the closure.

The container is a thin wall container, having a body and an opening, for example a neck. The body can have a wall comprising a bottom portion, a side portion, and a shoulder portion. The opening can be a neck provided on the shoulder portion opposite to the bottom portion. In an embodiment, to allow the deformation, and to allow plastic saving, the body has a low average thickness on at least a portion, preferably at least a portion representing at least 50% of length or surface of the body, preferably at least 80%, preferably all the body. The bottom and/or the shoulder can present higher average thicknesses, up to 100% more than the average thickness of the rest of the body. The average thickness of the body can be for example of from 30 μm to 200 μm, preferably from 50 μm to 150 μm, for example from 50 μm to 75 μm or from 75 μm to 100 μm or from 100 μm to 125 μm or from 125 μm to 150 μm.

The thickness of the blown container can be managed by adapting, for a given container reference volume, the preform, in particular its shape and wall thickness, and by adapting the stretching parameters. It is mentioned that the geometry of the preform, such as its length, its diameter, and its bottom shape, determine, together with the neck, the weight of the preform and thus the weight of the container. The stretching can be described by the following parameters:

Axial Stretch ratio (ratio between length of container under neck and the length of the preform under neck);

Hoop Stretch ratio (ratio between the diameter of container and the diameter of the preform, at half length);

Planar Stretch ratio: Axial Stretch Ratio X Hoop Stretch Ratio.

The planar stretch ratio can be for example of from 12.0 to 27.0, preferably from 15.0 to 20.0. The axial stretch ratio can be for example of from 3.0 to 4.5, preferably from 3.3 to 4.0. The hoop stretch ratio can be for example of from 4.0 to 6.0, preferably from 4.5 to 5.5.

The container can present a packaging efficacy, determined as ratio between the container weight and the liquid reference volume, of from 5.27 g/L to 9.33 g/L, preferably of from 5.27 g/L to 7.33 g/L, preferably form 5.80 g/L to 7.00 g/L.

The container can present a surface density, determined as the ratio between the surface of the body and the container weight, of from 100 to 200 g/m$^2$.

Such extra light containers require less raw material, are cheap, and present an increased capacity to collapse during the dispensing of fluid.

Advantageously, the container when filled with the liquid reference volume and sealed presents a top load resistance of at least 10 daN for at least 5 mm deformation and/or a lateral load resistance of at least 5 daN for at least 2.5 mm deformation.

Referring now to the geometry of the container 10, it is provided with a bottom portion 11, a side portion 12, a shoulder portion 13, and a neck portion 14.

The neck portion 14 is designed to receive a seal, and in the present case of FIG. 1, the seal is a cap 15, screwed onto the neck portion 14. However, other seals are possible, such as cap in snap fit engagement, or a lid held by glue or a weld.

The side portion 12 comprises a straight portion, that is to say that the side portion presents a cylindrical shape, and preferably a circular cylindrical shape. The thickness of the side portion 12 is sufficiently low to allow the deformation according to a preferred embodiment. For example for a PET container, the average thickness of the side portion can be of from 30 μm to 200 μm, preferably from 50 μm to 150 μm, for example from 50 μm to 75 μm or from 75 μm to 100 μm or from 100 μm to 125 μm or from 125 μm to 150 μm. Also, the side portion is free of ridge, edge, groove, or rib. Consequently, such a thin and smooth side portion 12 is easily deformable. However, containers having a side portion 12 with thicker wall (less deformable), with ridges, edges, grooves are also possible embodiments according to the present invention.

Referring to the bottom portion 11, it presents a hemispheric shape, and its thickness can be, for example for a PET container, of from 105 μm to 275 μm, preferably from 125 μm to 225 μm, for example from 125 μm to 150 μm or from 150 μm to 175 μm or from 175 μm to 200 μm or from 200 μm to 225 μm. Also, the bottom portion 11 is free of ridge, edge, groove, or rib. Consequently, such a thin and smooth bottom portion 11 is easily deformable. However, containers with thicker wall in the bottom portion (less deformable), with ridges, edges, grooves are also possible embodiments according to the present invention.

Referring to the shoulder portion 13, it presents a hemispheric shape, and its thickness can be, for example for a PET container, of from 105 μm to 275 μm, preferably from 125 μm to 225 μm, for example from 125 μm to 150 μm or from 150 μm to 175 μm or from 175 μm to 200 μm or from 200 μm to 225 μm. Also, the shoulder portion 13 is free of ridge, edge, groove, or rib. Consequently, such a thin and smooth shoulder portion 13 is easily deformable. However, containers with thicker wall in the shoulder portion (less deformable), with ridges, edges, grooves are also possible embodiments according to the present invention.

Advantageously, the bottom portion 11 and shoulder portion 13 present similar shape, and preferably, the bottom portion 11 and shoulder portion 13 present the same hemispheric shape. Consequently, when considering that the side portion 12 is a circular cylinder, the container 10 is symmetrical (except for the neck portion 14), and can be received equally in an upright or upside-down position in a device having a hemispherical female counterpart. In addition, such a shape provides an easier process of manufacturing, as being close to the natural shape upon blowing before, with low constrains upon conforming with the mold, during a blow molding process.

Figure 2:
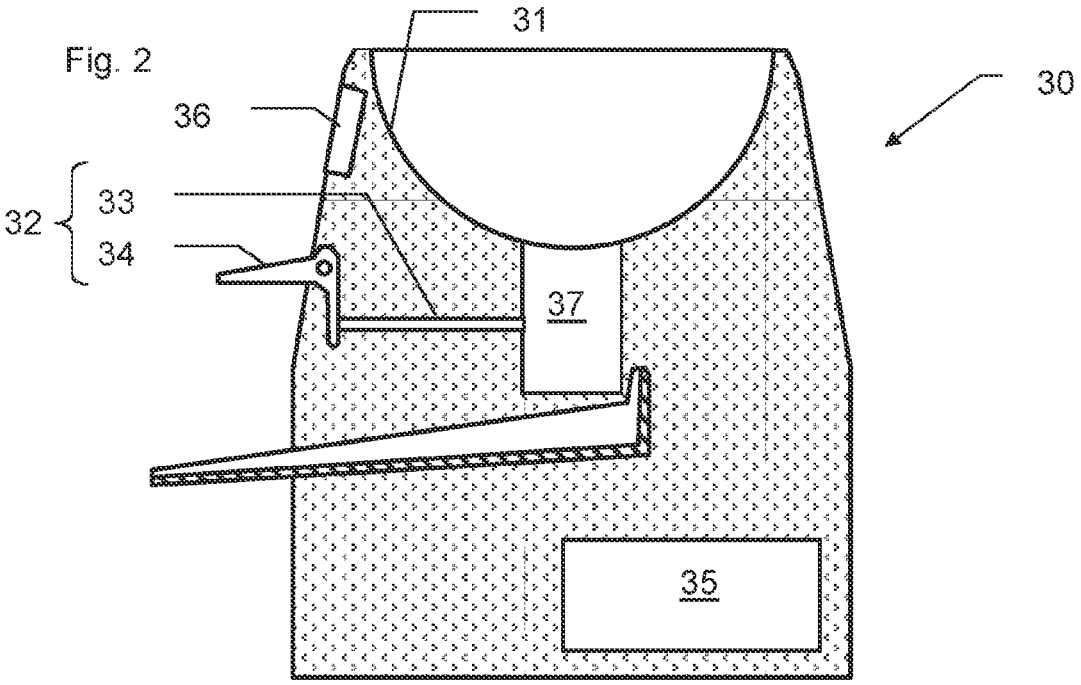
FIG. 2 represents a dispenser for a system according to the present invention.

FIG. 2 represents a dispenser 30 for the system of the present invention. The dispenser 30 is arranged to receive and hold the container 10 of FIG. 1. In particular, the dispenser 30 comprises a receiving portion 31, having an hemispheric shape similar to that of the bottom portion 11 and shoulder portion 13 of the container 10. In other words, the shape of the receiving portion is the counter shape of the shape of the bottom portion and shoulder portion.

The dispenser 30 also comprises a control unit 32 notably comprising a shaft 33 and a lever 34 for manual actuation of dispensing by a user, as will be explained hereunder. The bottom part of the receiving portion 31 presents a hollow portion, forming a well or recess 37, where the shaft 33 can access. Despite being not shown, the control unit 32 also comprises elastic means for automatic positioning of the lever 34 into the rest position shown on FIG. 2. In some embodiments, the control unit might also comprise electric actuators to perform some functions that will be detailed hereunder.

In some embodiments, the dispenser might also comprise an electronic unit 35, to measure a content of fluid into the container 10, a screen 36 to send or display information to the user, a communication unit, to provide exchange of data between a remote server via radio waves, internet, . . . ) or to a portable device, such as a smartphone of the user.

Figure 3:
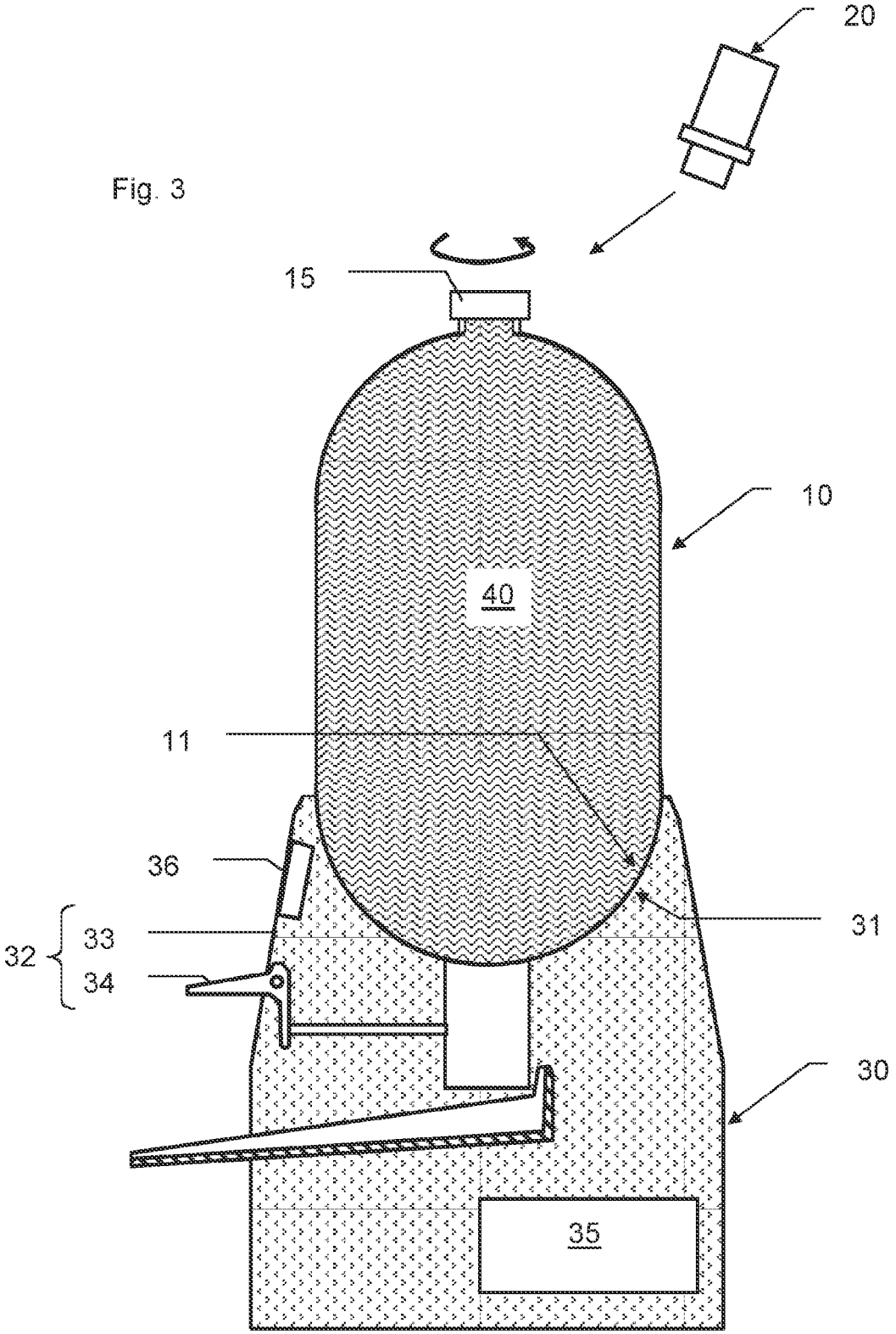
FIG. 3 represents a system of the present invention, comprising the container of FIG. 1, filled with fluid and received in the dispenser of FIG. 2 in an upright position, and a valve to connect to the container.

FIG. 3 represents a system according to the invention, comprising the container 10 of FIG. 1, filled with a liquid 40 (still water for example), the dispenser 30 of FIG. 2, and a valve 20 to be connected to the container 10.

The valve 20 is designed to be coupled to the container 10 via its neck portion 14. Basically, the valve 20 is arranged to cooperate with the control unit 32 of the dispenser to dispense the liquid 40 of the container 10. In particular, there is at least one orifice in the valve 20 which can be closed or opened to release liquid out of the container 10.

As already explained, the dispenser 30 is arranged to receive and hold the container 10 of FIG. 1. The container 10 as represented in this FIG. 3 has a container reference volume (for example 5 liters), and is fully or almost fully filled with a liquid 40 having a fluid reference volume, and liquid 40 is for example sill water. Preferably, the fluid reference volume is at least 90% of the container volume, and more preferably at least 95% of the container reference volume.

In particular, the dispenser 30 comprises a receiving portion 31, having an hemispheric shape similar to that of the bottom portion 11 and shoulder portion 13 of the container 10. Consequently, the container 10 might be received and held into an upright position by the dispenser via its bottom portion 11, as shown FIGS. 3 and 4, or in an upside down position vis its shoulder portion 13, as shown FIGS. 5-8.

Figure 4:
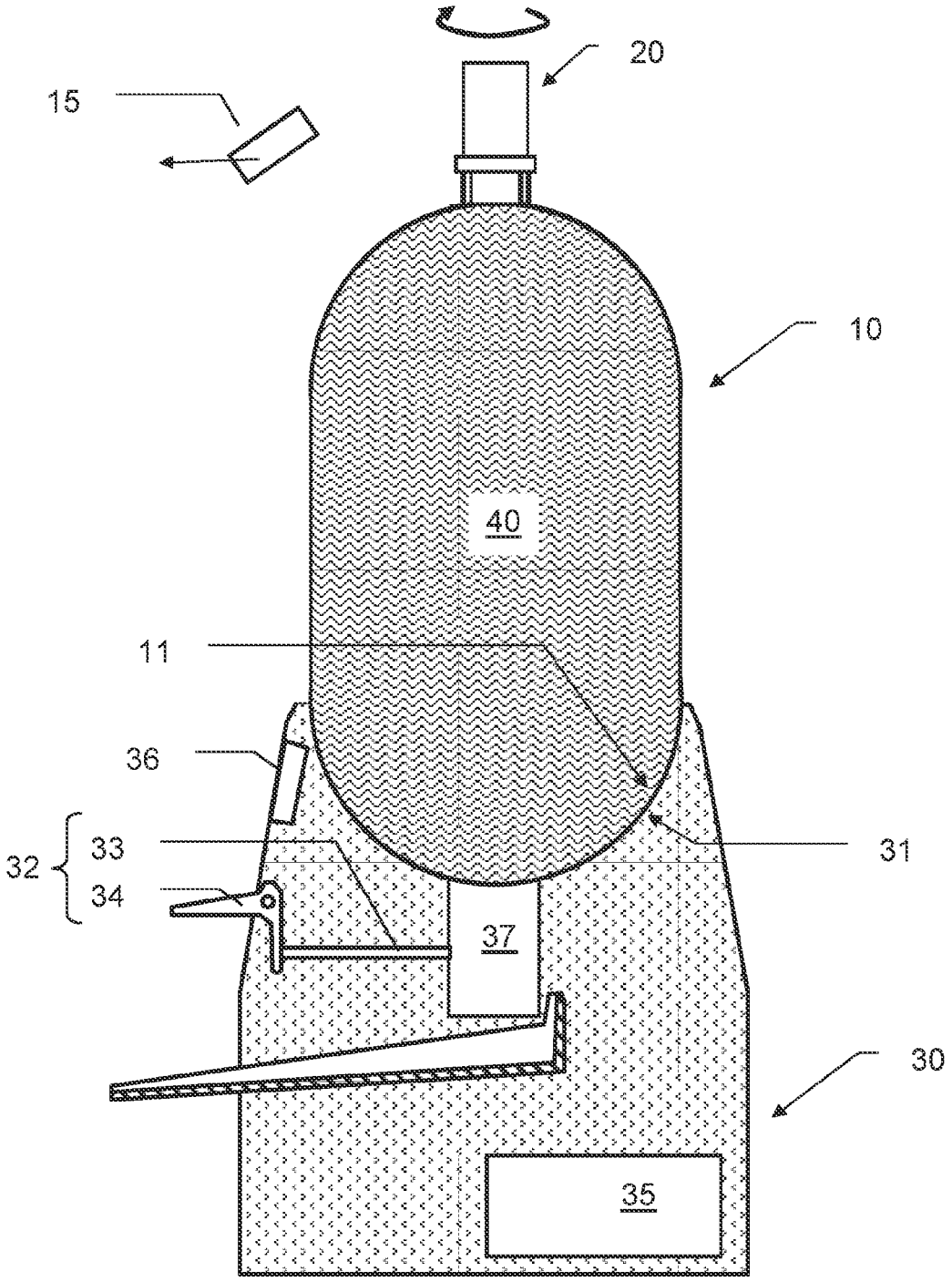
FIG. 4 represents the system of FIG. 3, with the valve coupled to the container.

FIGS. 3 and 4 represent the container 10 stably received by the dispenser 30, in an upright position, so that a user can easily remove the seal cap 15 and install the valve 20, as shown. In such upright stable position, unscrewing the cap 15 (FIG. 3) and screwing the valve 20 (FIG. 4) is easy.

For example, if the container 10 is delivered to the user's house in a cardboard box, the user after removal from this cardboard box, can place the container 10 directly into the receiving portion, to remove the cap 15 as above explained. Handling is easy.

Moreover, as according to some embodiments, the container 10 might be deformable or highly deformable (thin and free of ridges/grooves wall), the hemispheric receiving portion allows stable holding without deforming container 10, so that the cap 15 can be easily and safely removed, without leaks or drops of water projected or expelled out of the container 10.

Figure 5:
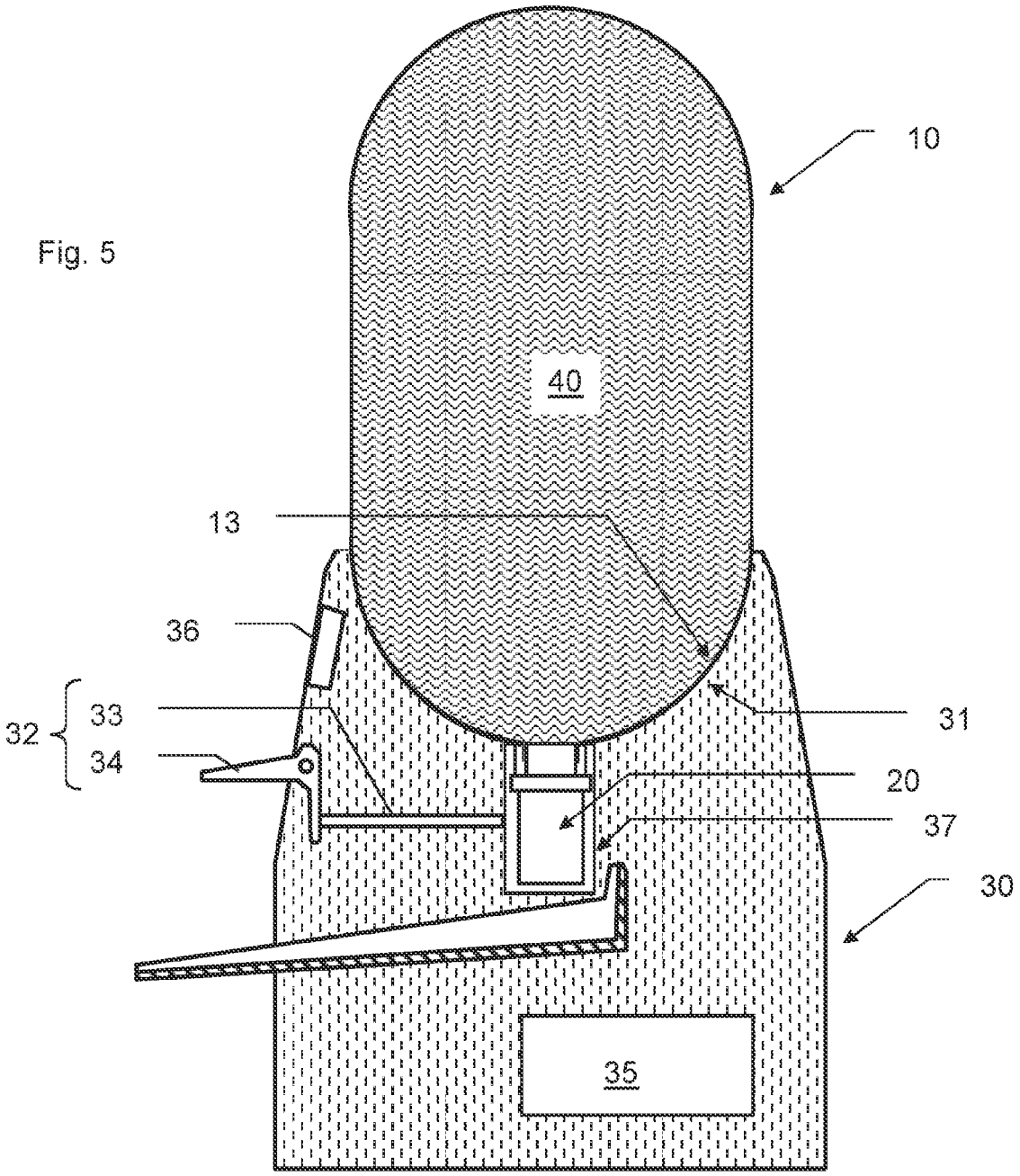
FIG. 5 represents the system of FIG. 4, with the container coupled to the valve, in a dispensing or upside-down position, and coupled to the dispenser.

FIG. 5 shows the container 10 in an upside-down position, held via its shoulder portion 13 in the receiving portion 31 of the dispenser 30, the valve 20 being received in the recess 37 of the dispenser 30. In that position, the shaft 33 faces the valve 20.

First of all, it has to be noted that since the shoulder portion 13 has the same general shape than the bottom portion 11, it is easy for the user to position the container 10 from the upright position to the dispensing or upside down position, as there is no specific operation on the dispenser to execute.

Figure 6:
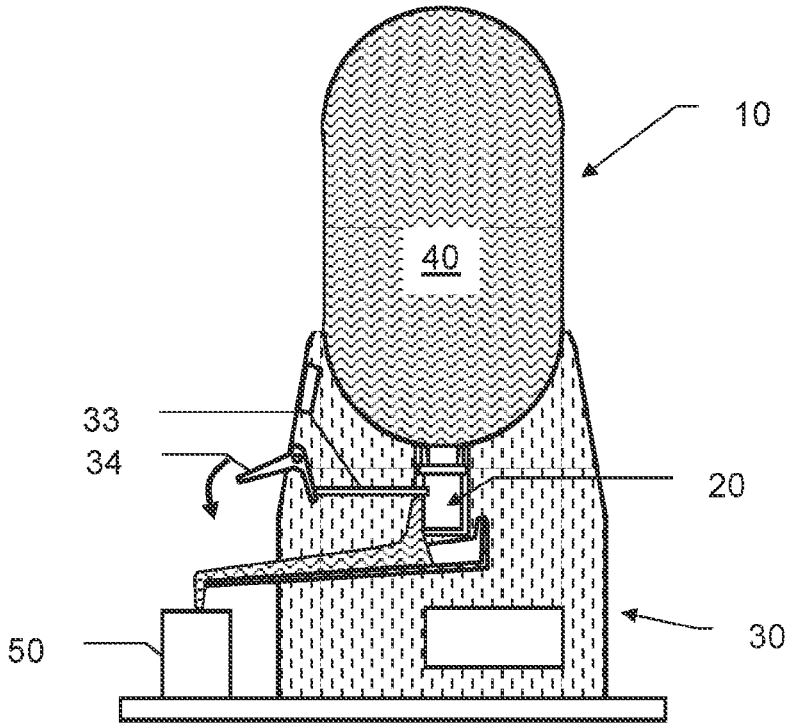
FIGS. 6 to 8 represent the system of FIG. 5, at different moments of draining fluid out of the container.

Further, as shown on FIG. 6, when the user pushes the lever 34, the shaft 33 moves towards the valve 20 and actuates it, releasing the liquid 40 out of the container 10, which is dispensed into a cup 50, as shown.

Figure 7:
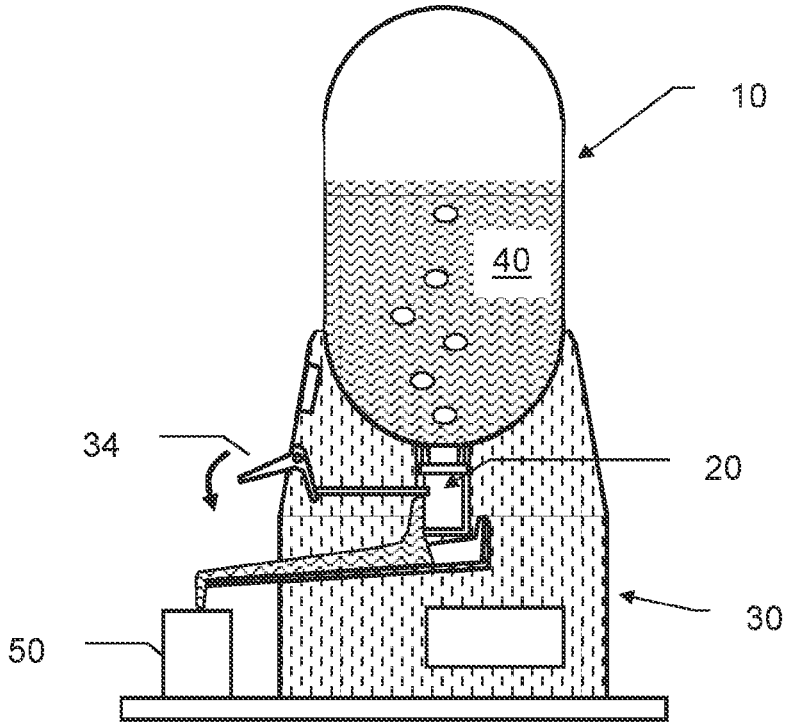
Figure 8:
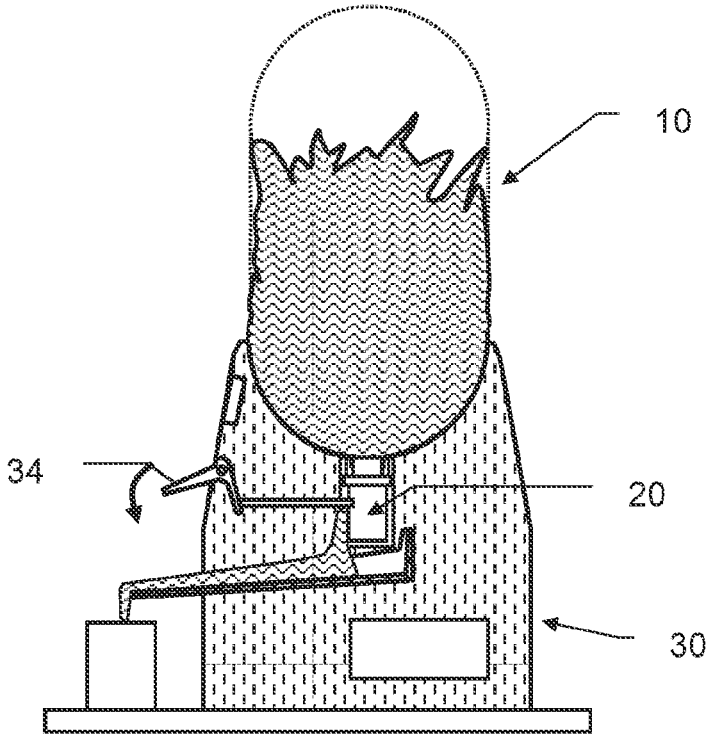

FIGS. 6, 7 and 8 represent different periods of use, and different scenarios.

FIG. 6 represents the dispensing of liquid when the container 10 is still full or almost full of liquid 40.

According to a first embodiment shown on FIG. 7, the container 10 is rigid enough to withstand the atmospheric pressure, so that draining liquid 40 out of the container 10 provokes entry of air, as shown.

According to a second embodiment shown on FIG. 8, the container 10 is deformable enough so that under the atmospheric pressure action, draining liquid 40 out of the container 10 provokes deformation of container 10 as shown, with no or low entry of air into container 10.

In particular, when one of characteristics of the container 10 is its low or thin thickness, the container 10 can easily deform when some liquid 40 is released out of the container 10, as shown on FIG. 8. In addition, the valve 20 might be designed so that during the dispensing phase shown on FIG. 8, only liquid 40 is released out of the container 10, and no or very few gas or air is allowed to enter the container 10, the latter thereby deforming to fully or almost fully compensate the loss of fluid.

Such dispensing phase, with no or very limited entry of air into the container 10 ensures that the liquid 40 is not polluted or contaminated with any external component. Therefore, the freshness and storage life time are longer compared to the case if some external air would be allowed to enter the container 10 since the beginning of dispense of liquid 40.

Finally, in a second step, when the container 10 has deformed until a limit, it will not deform anymore, so that dispensing of liquid 40 will provoke air entry, similarly to the rigid container 10 of FIG. 7.

EXAMPLE 1

A detailed example of a rPET container of 5.0 L of water (reference volume) is given below as a non limiting example of a container for the system according to the present invention. Other shapes (dimension, thickness, outer shape . . . ) of containers are possible embodiments.

Figure 9:
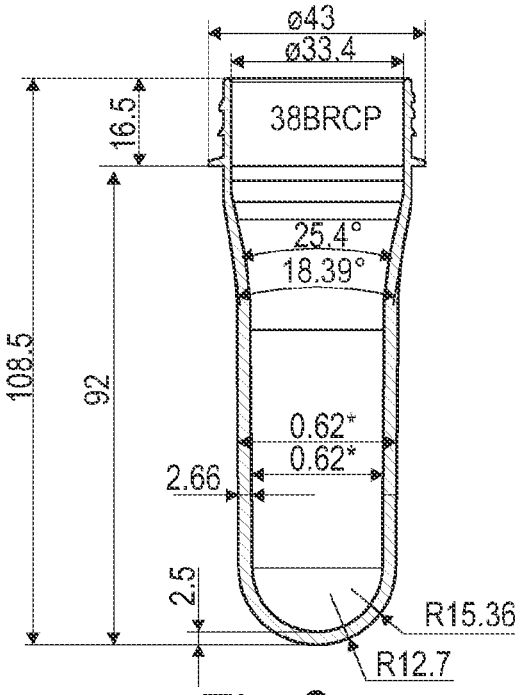
FIG. 9 represents an appropriate PET preform of 32 g, for forming a 5 L container. Dimensions are in mm.
Figure 10:
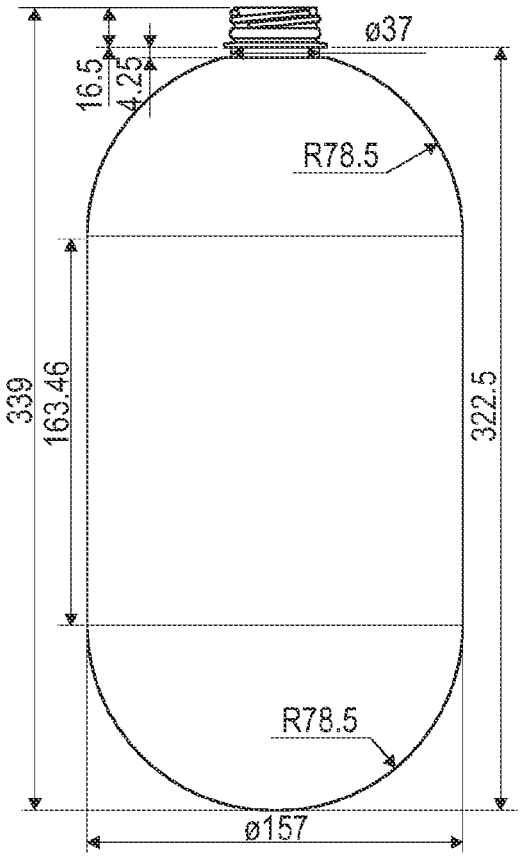
FIG. 10 represents an appropriate PET 5 L container of 32 g, formed from the preform of FIG. 9. Dimensions are in mm.

In the detailed example, the container 10 is prepared by Injection Stretch Blow Molding the preform 10A represented on FIG. 9, where dimensions are in mm, to obtain the container 10 represented on FIG. 10, where dimensions are in mm. The main parameters and features are reported on table 1 below. The container is filled with 5.0 L of water, and sealed with a screw cap.

TABLE 1

| Material and weight (Preform weight) | 32 g rPET |
|---|---|
| Weight under Neck (g) | 27.49 |
| Preform body external diameter (mm) | 31.32 |
| Preform body internal diameter (mm) | 26 |
| Preform body thickness (mm) | 2.66 |
| Preform length under neck (mm) | 92 |
| Container diameter (mm) | 157.0 |
| Container length under neck (mm) | 322.5 |
| Shoulder curve radius (mm) | 78.5 |
| Bottom curve radius (mm) | 78.5 |
| Container Reference (cm3) | 5191 |
| Container Surface under neck ($cm^2$) | 1576.96 |
| Axial stretch ratio | 3.57 |
| Hoop stretch ratio | 5 |
| Planar stretch ratio | 17.85 |
| Thickness at shoulder (μm) | 167 |
| Thickness at sidewall (μm) | 89.5 |
| Thickness at bottom (μm) | 167 |
| g/m2 under neck | 161.83 $g/m^2$ |
| Packaging efficacy (g/L) | 6.4 |
| Blowing Equipment type | One blow |
| Preform blowing temperature | 85° C. |
| Blowing pressures | 8 bars pre-blow<br>30 bars blow |
| Blowing time (s) | 1.7 |
| Mold Temperature | 25° C. |

EXAMPLE 2

A rPET container of 5.0 L of water (reference volume) is implemented.

Figure 11:
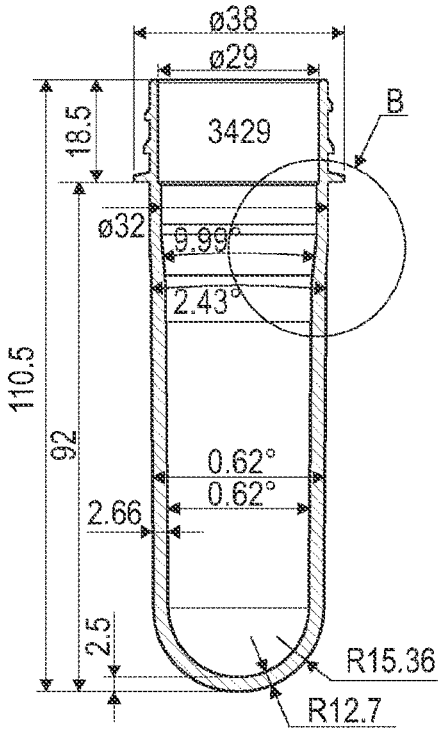
FIG. 11 represents another appropriate PET preform of 32 g, for forming a 5 L container. Dimensions are in mm.
Figure 12:
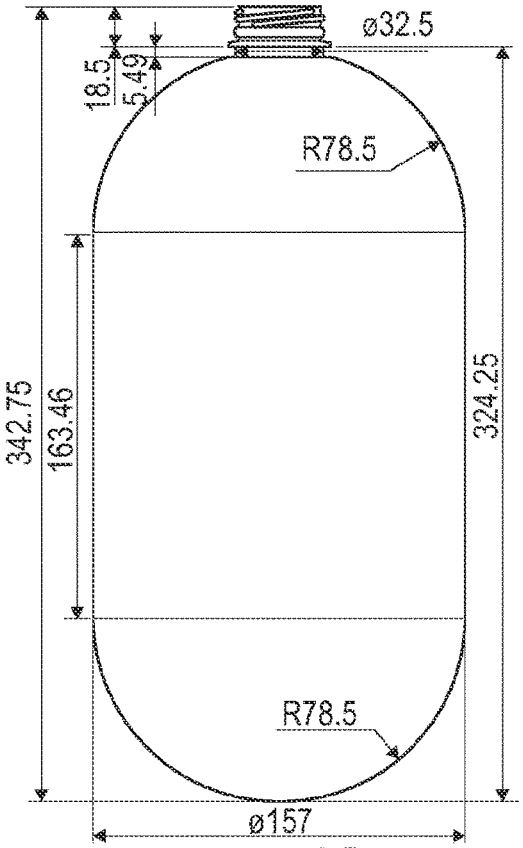
FIG. 12 represents an appropriate PET 5 L container of 32 g, formed from the preform of FIG. 11. Dimensions are in mm.

The container is prepared by Injection Stretch Blow Molding the preform represented on FIG. 11, where dimensions are in mm, to obtain the container represented on FIG. 12, where dimensions are in mm. The main parameters and features are reported on table 2 below. The container is filled with 5.0 L of water, and sealed with a screw cap.

TABLE 2

| Preform Material | rPET-EcoPet CB 0C 78 supplied by FPR |
|---|---|
| Preform weight (g) | 32 |
| Preform neck type: diameter including threads - internal diameter (mm) | 34-29 |
| Weight under Neck (g) | 27.36 |
| Preform body external diameter (mm) | 31.02 |
| Preform body internal diameter (mm) | 25.7 |
| Preform body thickness (mm) | 2.66 |
| Preform length under neck (mm) | 92 |
| Container diameter (mm) | 157.0 |
| Container length under neck (mm) | 324.25 |
| Shoulder curve radius (mm) | 78.5 |
| Bottom curve radius (mm) | 78.5 |

TABLE 2-continued

| Preform Material | rPET-EcoPet CB 0C 78 supplied by FPR |
|---|---|
| Container Reference (cm3) | 5177 |
| Container Surface under neck ($cm^2$) | 1613 |
| Axial stretch ratio | 3.52 |
| Hoop stretch ratio | 5.06 |
| Planar stretch ratio | 17.81 |
| Thickness at shoulder (μm) | 155 |
| Thickness at sidewall (μm) | 100 |
| Thickness at bottom (μm) | 155 |
| g/m2 under neck | 169.62 |
| Packaging efficacy (g/L) | 6.4 |
| Blowing Equipment type | 1 blow |
| Preform blowing temperature | 85° C. |
| Blowing pressures | 8 bars pre-blow<br>30 bars blow |
| Blowing time (s) | 1.7 |
| Mold Temperature | 15° C. |

It is of course understood that obvious improvements and/or modifications for one skilled in the art may be implemented, still being under the scope of the invention as it is defined by the appended claims.

The invention claimed is:

1. System for dispensing a liquid to a user, comprising:

a container having a reference container volume and comprising a wall with:

a bottom portion, a side portion adjacent to the bottom portion, a shoulder portion adjacent to the side portion, a liquid, in the container, a dispenser, arranged to receive and hold the container, characterized in that:

the bottom portion of the container and the shoulder portion of the container have a male shape, the dispenser comprises a receiving portion having a female shape arranged to mate either with the bottom portion or with the shoulder portion, so that the coupling provided by the receiving portion is the same with bottom portion of the container or shoulder portion of the container so as to stably hold the container, wherein the bottom portion and the shoulder portion present a hemispherical shape and wherein the receiving portion presents a hemispherical counter-shape so that the pressure of the container is distributed to the receiving portion, and wherein the container can be reversibly received in the receiving portion in a first upright position to remove a seal from the container, and in a second upside down position to allow the liquid to be dispensed out of the container.

2. The system according to claim 1, wherein the container comprises a neck, and wherein the receiving portion comprises a hollow portion forming a well to receive the neck, when the container is held in the dispensing position.

3. The system according to claim 1, wherein the side portion comprises a straight part.

4. The system according to claim 3, wherein the side portion is cylindrical.

5. The system according to claim 1, wherein the container wall is free of ridge, rib, or groove.

6. The system according to claim 1, wherein the container is made of polyethylene terephthalate (PET).

7. The system according to claim 1, wherein the container has a ratio between container weight and container reference volume of from 5.27 g/L to 9.33 g/L.

8. The system according to claim 1, wherein the container reference volume is of at least 3.0 L.

9. The system according to claim 1, wherein the container is a blow molded container.

10. The system according to claim 1, wherein the container is deformable.

11. The system according to claim 1, comprising:

a control unit arranged in the dispenser, to be actuated by the user, a valve connected to the container, and connected to the control unit to selectively release or stop a flow of the liquid out of the container, characterized in that:

upon releasing at least a part of the liquid, the container is deformable so that the container volume decreases to compensate at least 80%, or 90% or 99% or 100% of the liquid volume drained out of the container, the valve releasing a flow of the liquid out of the container when the control unit is actuated by the user, and upon releasing at least another part of the liquid, the valve releases a flow of liquid out of the container, and allows a flow of gas into the container when the control unit is actuated by the user.

12. The system according to claim 1, wherein the liquid is a beverage.

13. Container for the system according to claim 1.

14. Dispenser for the system according to claim 1.

15. A process of dispensing liquid to a user with the system of claim 11, comprising the following steps:

positioning the bottom portion of the container full of liquid in the receiving portion so as to hold the container in a stable upright position, removing a seal attached to the container, attaching a normally closed valve to the container, returning the container to position the shoulder portion of the container in the receiving portion so as to hold the container in a stable upside down position, while coupling the valve to a control unit of the dispenser, operating the control unit so as to open the valve and to dispense liquid to the user.

16. Use of the system according to claim 1, comprising the following steps:

positioning the bottom portion of the container in the receiving portion so as to hold the container in a stable upright position, removing a seal attached to the container, attaching a normally closed valve to the container, returning the container to position the shoulder of container in the receiving portion so as to hold the container in a stable upside down position, while positioning the valve into a hollow portion of the receiving portion.

17. The system according to claim 3, wherein the side portion is a circular cylinder.

18. The system according to claim 1, wherein the container is made of at least partly recycled polyethylene terephthalate (PET), or wherein the container is an injection blow molded container, or wherein the liquid is still water.

19. The system according to claim 1, wherein the container has a ratio between container weight and container reference volume of from 5.27 g/L to 7.33 g/L, or wherein the container reference volume is between 3.0 L to 22.0 L.

20. The system according to claim 1, further comprising:

an opening, provided on the shoulder, and a seal, for closing the opening.

* * * * *